US012565778B2

(12) United States Patent
Schneider et al.

(10) Patent No.: US 12,565,778 B2
(45) Date of Patent: Mar. 3, 2026

(54) LOCKING APPARATUS AND SYSTEM

(71) Applicant: Barrette Outdoor Living, Inc., Middleburg Heights, OH (US)

(72) Inventors: Christopher Michael Schneider, Linwood, NJ (US); Paige Barbara Moore, Absecon, NJ (US); Patrick Joseph Bertke, Mays Landing, NJ (US)

(73) Assignee: Barrette Outdoor Living, Inc., Middleburg Heights, OH (US)

( * ) Notice: Subject to any disclaimer, the term of this patent is extended or adjusted under 35 U.S.C. 154(b) by 400 days.

(21) Appl. No.: 17/960,220

(22) Filed: Oct. 5, 2022

(65) Prior Publication Data

US 2024/0117639 A1 Apr. 11, 2024

(51) Int. Cl.
*E04F 13/08* (2006.01)

(52) U.S. Cl.
CPC ..... *E04F 13/0841* (2013.01)

(58) Field of Classification Search
CPC .... E04F 13/0841; F16B 5/0084; F16B 21/02; F16B 2200/73; Y10T 403/7005
USPC ..... 52/767
See application file for complete search history.

(56) References Cited

U.S. PATENT DOCUMENTS 3,136,017 A * 6/1964 Preziosi ..... F16B 21/02 24/DIG. 57
3,150,703 A * 9/1964 Preziosi ..... F16B 21/02 411/908
3,443,783 A * 5/1969 Fisher, V ..... F16B 21/02 411/908
3,490,300 A * 1/1970 Toma ..... F16B 5/126 24/292
3,986,780 A * 10/1976 Nivet ..... F16B 21/02 411/908
5,076,748 A * 12/1991 Waterfield ..... F16B 35/041 411/84
5,155,960 A * 10/1992 Shaanan ..... F16B 21/02 24/DIG. 54

(Continued)

FOREIGN PATENT DOCUMENTS

CN 110905176 A * 3/2020
FR 2333993 A1 * 7/1977
GB 1410993 A * 10/1975 ..... A01G 9/16

OTHER PUBLICATIONS

Canadian Office action mailed Feb. 27, 2025; issued in connection with corresponding Canadian Patent Application No. 3,214,261 (7 pages total).

*Primary Examiner* — James M Ference
(74) *Attorney, Agent, or Firm* — John Maldjian, Esq.; Stevens & Lee PC

(57) ABSTRACT

A system includes one or more decorative screen panels configured at an initial position. The system also includes a locking and spacing apparatus positioned on an exterior portion of the one or more decorative screen panels. The spacer is positioned to receive a locking mechanism. The locking mechanism is positioned on the locking and spacing apparatus over the one or more decorative screen panels. A first portion of the locking mechanism is positioned within the spacer. A second portion of the locking mechanism is positioned under the locking and spacing apparatus and configured to move in a perpendicular direction. The movement in the perpendicular direction secures the locking mechanism within the locking and spacing apparatus.

19 Claims, 5 Drawing Sheets

(56) References Cited

U.S. PATENT DOCUMENTS 5,593,265 A * 1/1997 Kizer ..... F16B 21/02 403/348
7,819,370 B2 * 10/2010 Ho ..... F16B 17/008 24/580.11
8,281,934 B1 * 10/2012 Connolly ..... B07B 1/4645 209/393
8,375,654 B1 * 2/2013 West ..... F24S 25/20 52/173.3
8,505,864 B1 * 8/2013 Taylor ..... H02S 20/23 52/173.3
8,727,127 B2 * 5/2014 Woodgate ..... B07B 1/4645 209/403
8,997,428 B2 * 4/2015 Souchek ..... E21B 15/00 52/584.1
9,422,957 B2 * 8/2016 Dinh ..... F24S 25/636
9,484,853 B2 * 11/2016 Stapleton ..... F24S 25/61
10,405,676 B1 * 9/2019 Underwood ..... A47F 5/06
10,749,459 B1 * 8/2020 Liu ..... F16B 5/0685
2001/0036392 A1 * 11/2001 Reddicliffe ..... F16B 19/00 411/349
2002/0187017 A1 * 12/2002 Rogers ..... F16B 21/02 411/349
2003/0039529 A1 * 2/2003 Ward ..... F16B 37/042 411/173
2003/0059255 A1 * 3/2003 Kirchen ..... F16B 21/086 403/353
2004/0170491 A1 * 9/2004 Hulin ..... F16B 21/09 411/553
2008/0307726 A1 * 12/2008 Bergman ..... E04F 19/06 52/281
2009/0301944 A1 * 12/2009 Kriel ..... B07B 1/4645 403/14
2010/0275549 A1 * 11/2010 Bruce ..... F24S 25/33 24/457
2011/0100434 A1 * 5/2011 Van Walraven ..... F24S 25/636 136/251
2011/0138585 A1 * 6/2011 Kmita ..... F24S 25/636 24/522
2011/0262243 A1 * 10/2011 Glickman ..... F16B 21/02 411/347
2013/0140416 A1 * 6/2013 West ..... F24S 25/20 248/231.81
2013/0200245 A1 * 8/2013 Markiewicz ..... F16B 7/187 248/500
2014/0010616 A1 * 1/2014 Meine ..... F16B 7/187 411/190
2014/0053891 A1 * 2/2014 West ..... F24S 25/16 136/251
2014/0182662 A1 * 7/2014 West ..... H02S 30/10 248/617
2015/0101655 A1 * 4/2015 Schuit ..... F16B 2/065 136/251
2015/0102194 A1 * 4/2015 Liu ..... F24S 25/636 248/316.1
2015/0113889 A1 * 4/2015 Stapleton ..... E04B 1/388 52/173.3
2015/0184896 A1 * 7/2015 Lippert ..... F24S 25/12 211/41.1
2015/0204583 A1 * 7/2015 Stephan ..... F24S 25/67 403/375
2017/0297771 A1 * 10/2017 Houck ..... B66C 1/66
2019/0119969 A1 * 4/2019 Bell ..... B60J 5/107
2019/0123460 A1 * 4/2019 Ash ..... F24S 25/636
2019/0127987 A1 * 5/2019 Schneider ..... E04B 1/5806
2019/0335926 A1 * 11/2019 Farrar ..... F16B 21/02
2021/0115958 A1 * 4/2021 Blum ..... F16B 21/02
2021/0172467 A1 * 6/2021 Fluhrer ..... E06B 3/964
2024/0117639 A1 * 4/2024 Schneider ..... F16B 5/0084

* cited by examiner

LOCKING APPARATUS AND SYSTEM

FIELD OF INVENTION

Embodiments of the present invention generally relate to locking system to secure a decorative screen panel onto an interconnected structure.

BACKGROUND

Typical locking mechanisms within interconnected structures can often be inefficient. A measure of the typical inefficiency can be that the locking mechanism will be very cumbersome to execute. The locking mechanism can take a large amount of space. As a result, the aesthetic appeal of the interconnected structure will be reduced due to the appearance of the locking mechanism.

The efficiency in which the locking mechanism can be locked often makes such a locking mechanism difficult to apply within an interconnected structure. In many instances, one or keys are required to lock and unlock the unlocking mechanism within the interconnected structure.

The amount of space in which the locking mechanism takes can often make it tedious to place the locking mechanism onto the desired position. Many locking mechanism can be very bulky, and have to be placed on a greater portion of the panel to be locked in place that what is desired.

Another issue with many locking mechanisms is being unable to securely fasten the panel or device on which the locking mechanism is secured. When one or more unforeseen events occur, the panel or device can lose its position and not be secured within its position by the locking mechanism.

Accordingly, a need exits for a locking mechanism that is easy to assemble and which does not take up as much space in the desired position. Further, a need exists for locking mechanism to securely hold in placed the panel or object at the desired position. Further, the locking mechanism should be able to hold the panel and/or object in place when one or more unforeseen circumstances occur which apply unexpected force or pressure on the panel and/or object.

SUMMARY

Embodiments in accordance with the present invention provide system, wherein one or more decorative screen panels are configured at an initial position. The system also includes a locking and spacing apparatus positioned on an exterior portion of the one or more decorative screen panels, wherein a spacer within the locking and spacing apparatus is positioned to receive a locking mechanism. The system also includes the locking mechanism positioned on the locking and spacing apparatus over the one or more decorative screen panels. A first portion of the locking mechanism is positioned within the spacer of the locking and spacing apparatus. A second portion of the locking mechanism is positioned under the locking and spacing apparatus and configured to move in a perpendicular direction. The second portion's movement in the perpendicular direction secures the locking mechanism within the locking and spacing apparatus.

The spacer is positioned in a center portion of the locking and spacing apparatus.

The first portion of the locking mechanism is positioned within the spacer and over an exterior portion of the one or more decorative screen panels.

In an embodiment of the present invention, a system includes a decorative screen panel configured at an initial position. The system also includes a spacer configured onto the decorative screen panel, wherein the spacer is configured on an exterior portion of the decorative screen panel, wherein a center portion of the spacer includes an opening for one or more devices. The system also includes a camlock device positioned on the spacer on the exterior portion of the decorative screen panel. A first portion of the camlock device is positioned within the spacer. A second portion of the camlock device is positioned under the spacer. The first and second portions of the camlock device are rotated to secure the spacer onto the decorative screen panel.

The first portion of the camlock device is rotated in a perpendicular direction to secure the spacer onto the decorative screen panel.

The second portion of the camlock device is rotated in a same direction as the first portion of the camlock device to secure the camlock device over the decorative screen panel.

According to another embodiment of the present invention, a method includes configuring one or more decorative screen panels cat an initial position. The method also includes positioning a locking and spacing apparatus on an exterior portion of the one or more decorative screen panels, wherein a spacer within the locking and spacing apparatus is positioned to receive a locking mechanism. The method also includes configuring the locking mechanism on the locking and spacing apparatus over the one or more decorative screen panels. A first portion of the locking mechanism is positioned within the spacer of the locking and spacing apparatus. A second portion of the locking mechanism is positioned under the locking and spacing apparatus and configured to move in a perpendicular direction. The second portion's movement in the perpendicular direction secures the locking mechanism within the locking and spacing apparatus.

The method also includes rotating the first portion of the locking mechanism in the perpendicular direction in alignment with the second portion of the locking mechanism.

The method also includes positioning the first portion of the locking mechanism over the spacer to secure the locking and spacing apparatus.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The above and still further features and advantages of embodiments of the present invention will become apparent upon consideration of the following detailed description of embodiments thereof, especially when taken in conjunction with the accompanying drawings, and wherein.

Figure 1:
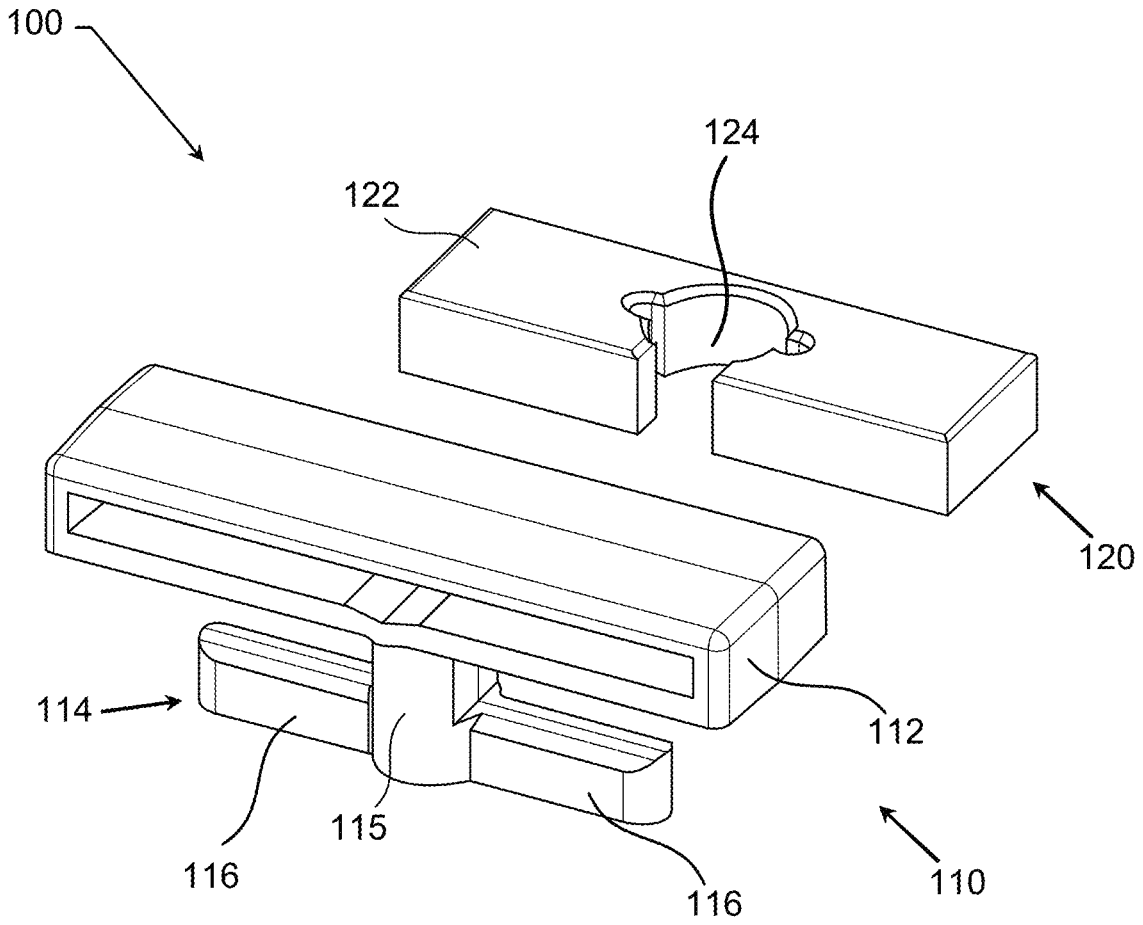
FIG. 1 illustrates a view of a portion of the twist and lock system.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures. Optional portions of the figures may be illustrated using dashed or dotted lines, unless the context of usage indicates otherwise.

DETAILED DESCRIPTION

An interconnected structure that is used to entertain guests or users at outdoor venues will often have decorative screen panels that placed at the top and/or side portions of the interconnected structure. The interconnected structure, in one or more embodiments, can include frame members, mid-beams, center beams, corner brackets, and corner posts. The interconnected structure can have a plurality of the decorative screen panels positioned adjacent to each other in the top and/or side portion of the interconnected structure. A combination of a camlock device and locking and spacing apparatus can secure the decorative screen panels within the interconnected structure.

The locking and spacing apparatus can have a spacer in a center region with a circular or round opening. The spacer of the locking and spacing apparatus can be configured to receive a portion of the camlock device to secure the decorative screen panels in place. The locking and spacing apparatus can have the camlock device positioned partly above, within, and below the locking and spacing apparatus.

The camlock device can include a first and second portion. A first portion of the camlock device can be positioned within and over the locking and spacing apparatus. Part of the first portion will be positioned within the spacer of the locking and spacing apparatus. Further, another part of the first portion will be positioned over the spacer. The second portion of the camlock device can be positioned underneath the locking and spacing apparatus. The length and width of the first portion of camlock device will be greater than the length and width of the second portion of the camlock device. When both the first and second portions of the camlock device are positioned above, within, and underneath the locking and spacing apparatus respectively, the camlock device can then secure the locking and spacing apparatus within the decorative screen panel. As such, the decorative screen panel can be held secure when force is applied or unforeseen circumstances occur.

The first and second portions of the camlock device can be aligned with each other when in their respective positions within, above, and underneath the locking and spacing apparatus. Both the first and second portions of the camlock device can be rotated perpendicularly to secure the locking and spacing apparatus within the respective decorative screen panel. Further, when both the first and second portions of the camlock device are fully rotated in the perpendicular direction, the locking and spacing apparatus will be secured within the decorative screen panel.

In FIG. 1, a system 100 is illustrated with two sets of devices that can be used in conjunction to provide a secure locking mechanism for decorative screen panels in an interconnected structure such as a T-Bar bracket structure. A camlock device 110 is shown. The camlock device 110 can have a top portion 112 and a bottom portion 114 that will be used to secure a decorative screen panel in the interconnected structure. The bottom portion 114 can be positioned in contact with a portion of the decorative screen panel and underneath a locking and spacing apparatus 120. The top portion 112 of the camlock device 110 can be positioned over the decorative screen panel and also over the bottom portion 114 of the camlock device 110 and the locking and spacing apparatus 120. When the camlock device 110 is set in its locking position, [the] both the top portion and bottom portion of the camlock device 110 are fully rotated in the perpendicular direction.

Referring to FIG. 1, a locking and spacing apparatus 120 is also shown. The locking and spacing apparatus 120 will work in conjunction with the camlock device 110 to secure a decorative screen panel securely in place within an interconnected T-bracket structure. The locking and spacing apparatus 120 includes a spacer 122. The spacer 122 can include a circular or round opening 124 within the center region of the locking and spacing apparatus 120. The spacer 122 is configured to receive a first portion 115 of the bottom portion 114 of the camlock device 110. The bottom portion 114 of the camlock device 110 is placed within the spacer 122 of the locking and spacing apparatus 120. The bottom portion 114 of the camlock device 110 will be directly below the top portion 112 of the camlock device 110 when the bottom portion 114 of the camlock device 110 is inserted within the spacer 122 of the locking and spacing apparatus 120.

Referring to FIG. 1, when the top portion 112 of the camlock device 110 is positioned above the spacer 122 of the locking and spacing apparatus 120, the first portion 115 of the bottom portion 114 of the camlock device 110 is positioned within the spacer 122 and the second portion 116 of the bottom portion 114 is positioned underneath the spacer 122. The bottom 114 and top portion 112 of the camlock device 110 will be rotated in a perpendicular direction to secure the locking and spacing apparatus in place onto a decorative screen panel. Both the top 112 and bottom portion 114 of the camlock device 110 will be aligned and will rotate at the same angle to secure the locking and spacing apparatus 120 in its position within a decorative screen panel.

Figure 2:
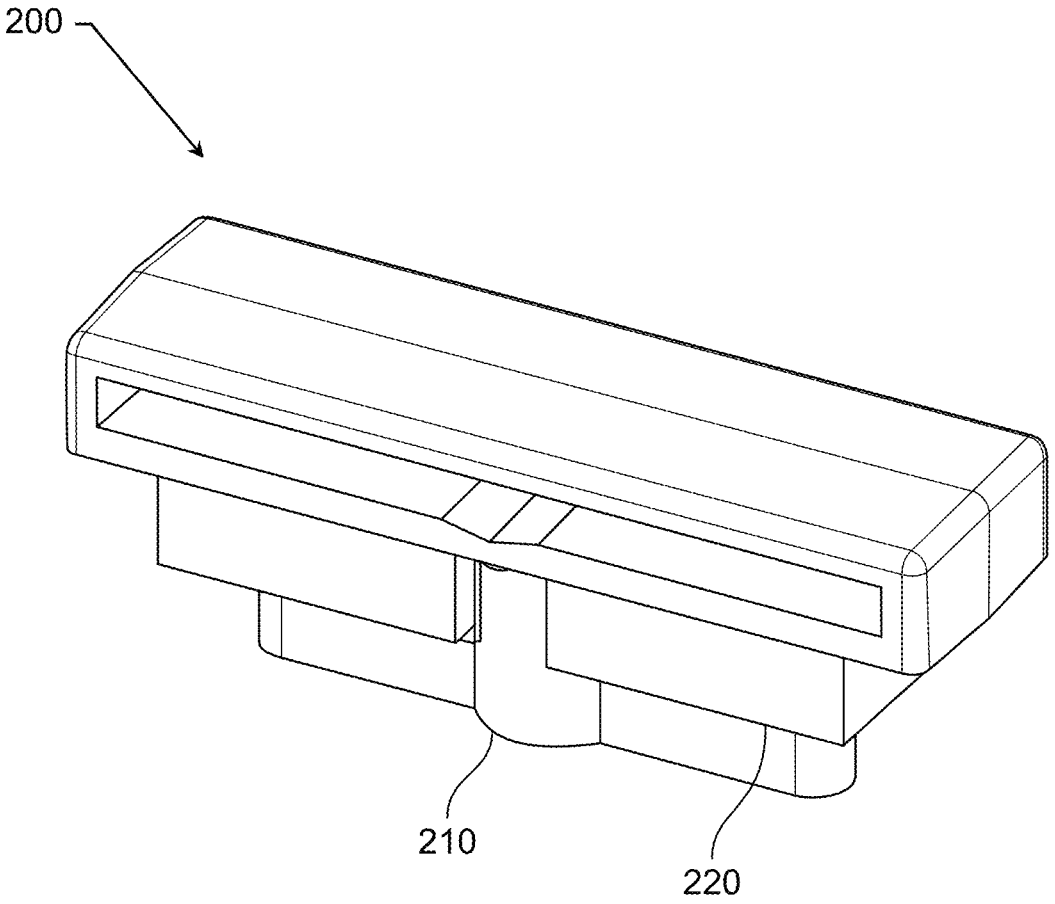
FIG. 2 illustrates another aspect of the twist and lock system.

In FIG. 2, a system 200 is shown with a camlock device 210 and locking and spacing apparatus 220. In this embodiment, the camlock device 210 is inserted within the locking and spacing apparatus 220 and also positioned above and below the locking and spacing apparatus 220.

Referring to FIG. 2, the system 200 with the locking and spacing apparatus 220 in an unlocked position. The bottom portion of the camlock device 210 is positioned within a spacer of the locking and spacing apparatus 220. The spacer of the locking and spacing apparatus 220 can be within a center region of the locking and spacing apparatus 220. The bottom portion of the camlock device 210 will be positioned within the spacer and also below the spacer. The bottom portion of the camlock device 210 will be aligned with the top portion of the camlock device 210. As such, before the locking and spacing apparatus 220 is secured onto one or more decorative screen panels within the system 200, the top and bottom portions of the camlock device 210 have to be in their respective positions.

In FIG. 2, the bottom portion of the camlock device 210 has to be inserted within the spacer and also be below the locking and spacing apparatus 220. The top portion of the camlock device 210 will be positioned above the locking and spacing apparatus 220. The length and width of the top portion of the camlock device 210 will be greater than the length and width of the top portion of the camlock device 210. The top and bottom portions of the camlock device 210 will also be aligned in its respective positions above, within and below the locking and spacing apparatus 220.

Figure 3:
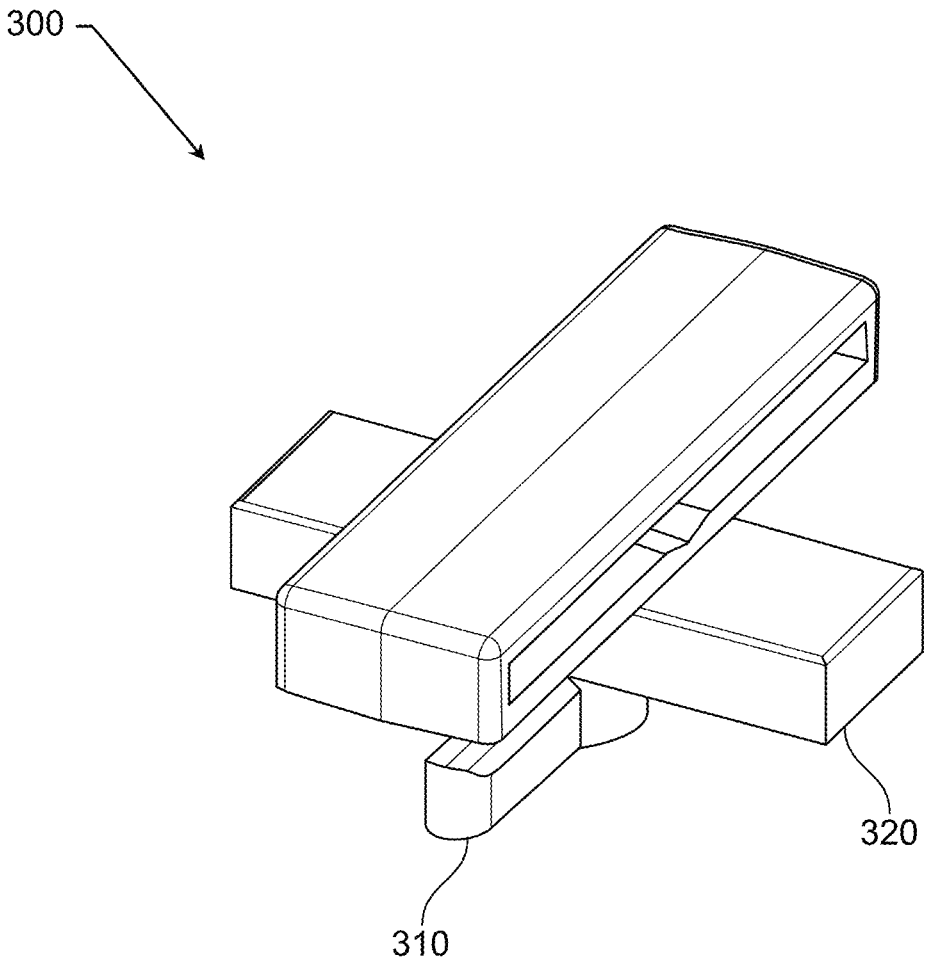
FIG. 3 illustrates a further aspect of the twist and lock system.

In FIG. 3, a system 300 is illustrated in which a locking and spacing apparatus is in a secured and locked position. The system 300 also illustrates the camlock device 310 and the locking and spacing apparatus 320. The locking and spacing apparatus 320, when positioned on an exterior frame of a decorative screen panel, must be secured and locked in place to enable the decorative screen panel to be secured and not fall out of place. As such, if the locking and spacing apparatus 320 is not secured in place, the decorative screen panel is likely to fall out of place when one or more unforeseen instances occur.

Referring to FIG. 3, the top and bottom portion of the camlock device 310 are rotated in the perpendicular direction to secure the locking and apparatus 320. When the bottom and top portions of the camlock device 310 are positioned in and around the locking and spacing apparatus 320, the top and bottom portions of the camlock device 310 are aligned. Both the top and bottom portions of the camlock device 310 are rotated perpendicularly to secure the locking and spacing apparatus 320 onto the decorative screen panel. Further, when the top and bottom portions of the camlock device 310 are each fully rotated in the perpendicular direction, the locking and spacing apparatus 320 is secured on the external frame of the decorative screen panel.

Figure 4:
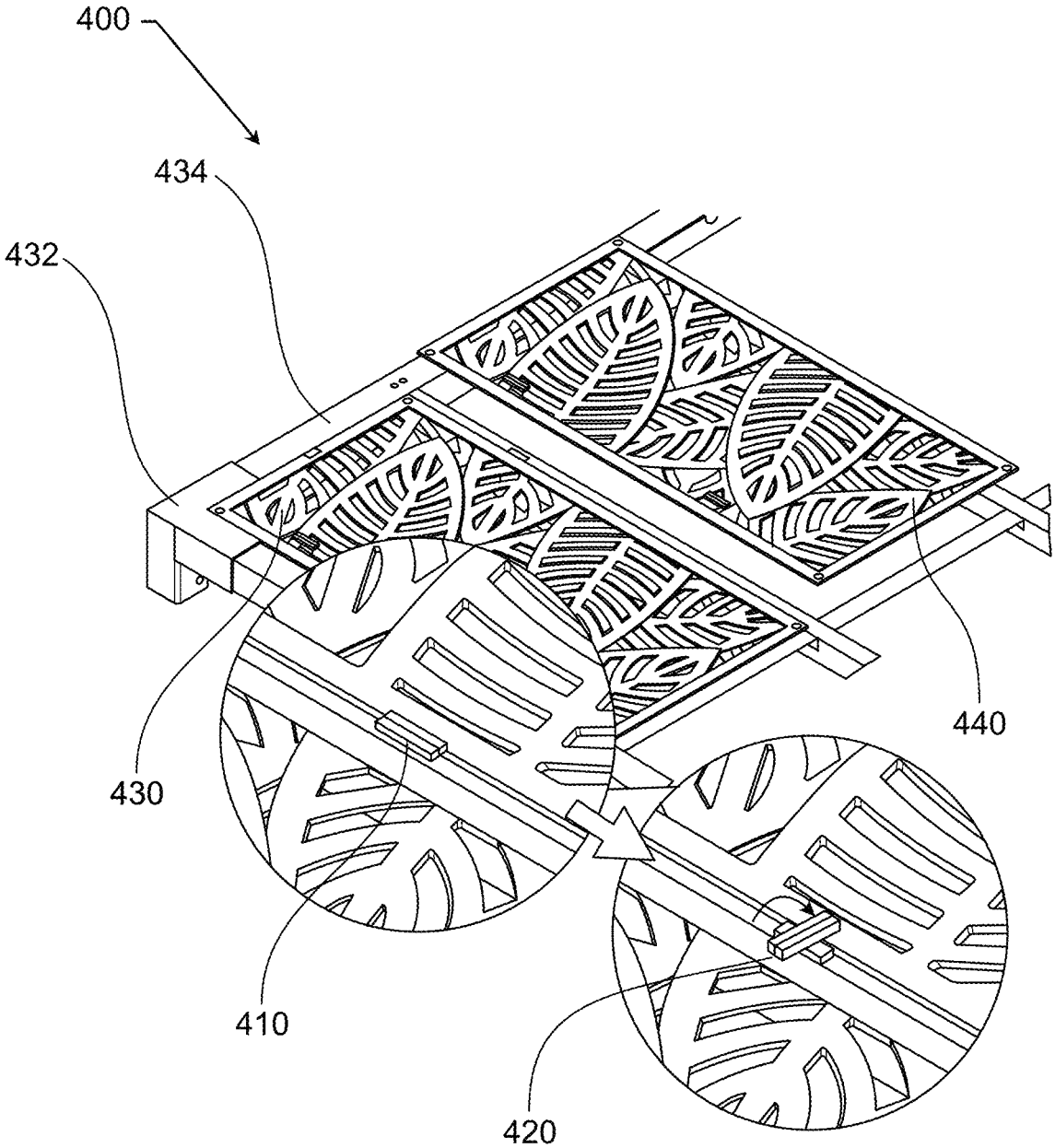
FIG. 4 illustrates an application of the twist and lock system.

In FIG. 4, a system 400 is illustrated with a plurality of decorative screen panels 430, 440. Moreover, a locking and spacing apparatus 410 is positioned onto an exterior portion of the one or more of the decorative screen panels 430, 440. To secure at least one of the decorative screen panels 430, 440 in place, the locking and spacing apparatus 410 must be moved to a locking position.

Referring to FIG. 4, the locking and spacing apparatus 410 can be configured on the exterior portion of either of the decorative screen panels 430, 440. The locking and spacing apparatus 410 will first be positioned on the exterior of at least one of the decorative screen panels 430, 440. The locking and spacing apparatus 410 will also have a spacer within a center region of the locking and spacing apparatus 410 to receive a camlock device 420 that will lock and secure the locking and spacing apparatus 410 on the one or more decorative screen panels 430, 440. The camlock device 420 will include a bottom portion that will be positioned within and underneath the spacer of the locking and spacing apparatus 410. The camlock device 420 will also include a top portion that will be positioned above the locking and spacing apparatus 410.

In FIG. 4, the top and bottom portions of the camlock device 420 are rotated in the perpendicular direction to place the locking and spacing apparatus 410 in a locked position. As the top and bottom portions of the camlock device 420 are aligned above, within, and below the locking and spacing apparatus 410 respectively, both the top and bottom portions will rotate in the perpendicular direction. Further, when the top and bottom portions of the camlock device 420 are fully rotated in the perpendicular direction, the locking and spacing apparatus 410 will be secured on one or more of the decorative screen panels 430, 440. As a result, the one or more of the decorative screen panels 430, 440 will be securely held in place by the locking and spacing apparatus 410.

Figure 5:
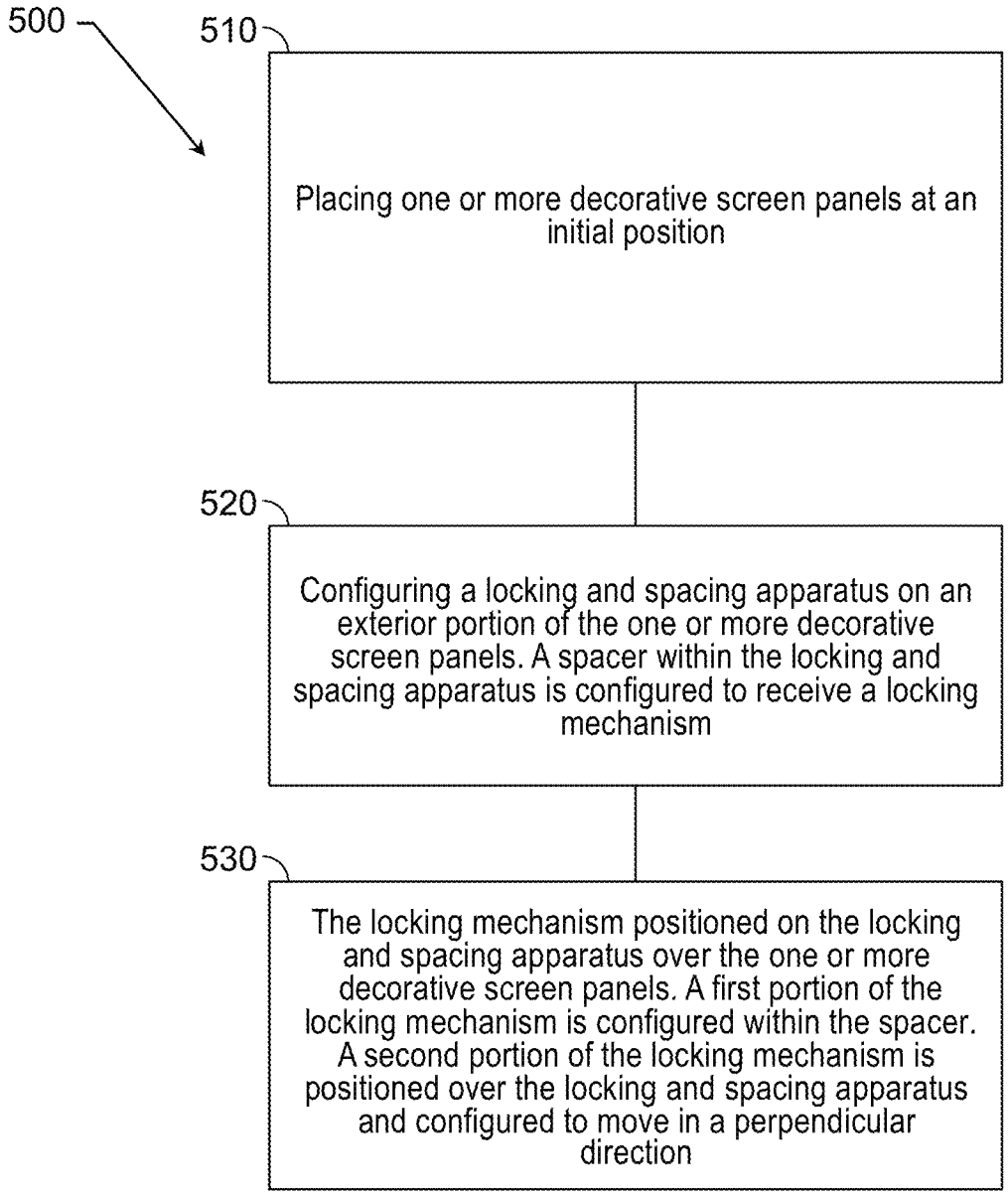
FIG. 5 illustrates a flow chart of the present invention.

Referring to FIG. 5, a method 500 is illustrated of securing a locking and spacing apparatus on one or more decorative screen panels. Moreover, the method 500 also includes a locking mechanism that secure the locking and spacing apparatus onto the one or more decorative screen panels.

In FIG. 5, at step 510, one or more decorative screen panels will be placed in an initial position. The initial position can be a top portion of an interconnected structure that includes corner posts and corner brackets. The one or more decorative screen panels can be placed in between a plurality of frame members 434 and corner brackets 432. In other embodiments, the one or more decorative screen panels can be on a side portion of the interconnected structure.

In FIG. 5, at step 520, a locking and spacing apparatus will be positioned on one or more decorative screen panels within an interconnected structure. The locking and spacing apparatus will include a spacer. The spacer will be positioned in a center region of the locking and spacing apparatus. The spacer will be configured to receive a locking mechanism to enable the locking and spacing apparatus to be secured onto the one or more decorative screen panels.

With respect to FIG. 5, at step 530, the locking mechanism is positioned on the locking and spacing apparatus over the one or more decorative screen panels. Moreover, a first portion of the locking mechanism is configured within the spacer. The first portion of the locking mechanism can also be positioned above the spacer as well. Further, a second portion of the locking mechanism is positioned under the locking and spacing apparatus. The first portion of the locking mechanism is configured to move in a perpendicular direction to lock the locking and spacing apparatus in place within the one or more decorative screen panels. The second portion of the locking mechanism is also aligned with the first portion of the locking mechanism. The second portion of the locking mechanism will also move in the perpendicular direction to lock the locking and spacing apparatus in place within the one or more decorative screen panels. When the first and second portion of the locking mechanism are fully rotated in the perpendicular direction, the locking and spacing apparatus will be secured onto the one or more decorative screen panels.

Advantages/Summary

In summary, the locking and spacing apparatus can be positioned within an exterior portion of decorative screen panels. The decorative screen panels can be positioned at a top or side portion of an interconnected structure. A camlock device will be used to secure the locking and spacing apparatus on the decorative screen panels. Moreover, a first portion of the camlock device will be positioned within a spacer region within the locking and spacing apparatus. The spacer will be positioned within or near a center region of the locking and spacing apparatus. The first portion of the camlock device will also be positioned above the locking and spacing apparatus. The second portion of the camlock device will be placed underneath the spacer and will be aligned with the first portion of the camlock device. The length and width of the second portion of the camlock device will be less than a length and width of the first portion of the camlock device.

When the first and second portions of the camlock device are placed above, within, and underneath the locking and spacing apparatus, the locking and spacing apparatus is still not secured within the one or more decorative screen panels. Accordingly, the first and second portion of the camlock device are rotated in the perpendicular direction to secure the locking and spacing apparatus onto the one or more decorative screen panels. Therefore, when the first and second portions of the camlock device are fully rotated in the perpendicular direction, the locking and spacing apparatus can be secured onto the one or more decorative screen panels.

The locking and spacing apparatus can prevent the decorative screen panel from falling out of place. If one or more unforeseen events occur, or if outside forces are applied, the decorative screen panel can remain securely in place within the interconnected structure. More traditional locking mechanisms on the perimeter or edges of the decorative screen panels are not required. The locking and spacing apparatus is an efficient locking mechanism that does not require a great mount of space or area in or around the decorative screen panels.

In the interconnected structure, in one or more embodiments, each decorative screen panel can include a locking and spacing apparatus that is secured onto the respective decorative screen panel by a camlock device. The locking and spacing apparatus will be configured in direct contact with the respective decorative screen panel. Further, when the camlock device is fully rotated perpendicularly, the locking and spacing apparatus will secure the decorative screen panel in place within the interconnected structure.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure.

The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

While the foregoing is directed to embodiments of the present disclosure, other and further embodiments of the present disclosure may be devised without departing from the basic scope thereof. It is understood that various embodiments described herein may be utilized in combination with any other embodiment described, without departing from the scope contained herein. Further, the foregoing description is not intended to be exhaustive or to limit the disclosure to the precise form disclosed.

Modifications and variations are possible in light of the above teachings or may be acquired from practice of the disclosure. Certain exemplary embodiments may be identified by use of an open-ended list that includes wording to indicate that the list items are representative of the embodiments.

The invention claimed is:

1. A system comprising:

a plurality of decorative screen panels configured at an initial position;

a spacer positioned proximal to and positioned between two of the plurality of decorative screen panels, wherein the spacer is positioned to receive a portion of a camlock device in a spacer opening and wherein the spacer is formed in a substantially cuboid shape, and wherein the spacer opening extends through at least one sidewall of the spacer and into a central portion of the spacer; and a camlock device comprising a top portion and a bottom portion, wherein the top portion is positioned over the spacer, at least a first portion of the bottom portion is positioned within the spacer, a second portion of the bottom portion is positioned under the plurality of decorative screen panels, and wherein the camlock device is configured to rotate relative to the spacer and the plurality of decorative screen panels such that the rotation of the camlock device relative to the spacer secures the camlock device within the spacer and secures the plurality of decorative screen panels in the initial position.

2. The system of claim 1, wherein the spacer is positioned between the top portion and the bottom portion.

3. The system of claim 1, wherein the top portion of the camlock device is positioned over the spacer and an exterior portion of the plurality of decorative screen panels.

4. The system of claim 1, wherein the camlock device is integrally formed and rotates in the perpendicular relative to the spacer to secure at least the top portion of the camlock device over the plurality of decorative screen panels.

5. The system of claim 1, wherein the spacer includes a circular opening to receive the first portion of the bottom portion of the camlock device.

6. The system of claim 1, wherein the top portion of the camlock device has a length that is greater than the length of second portion of the bottom portion of the camlock device.

7. The system of claim 1, wherein the top portion of the camlock device is configured to rotate to be oriented perpendicular relative to the spacer after being positioned within the spacer.

8. The system of claim 1, wherein in a first, locked, configuration the top portion and the bottom portion of the camlock device are substantially aligned with the spacer, and in a second, unlocked, configuration the top portion and bottom portion of the camlock device are substantially perpendicular relative to the spacer.

9. The system of claim 1, wherein the camlock device secures the plurality of decorative screen panels in between one or more corner brackets.

10. The system of claim 1, wherein the camlock device secures the plurality of decorative screen panels in between one or more frame members.

11. A method comprising:

configuring a plurality of decorative screen panels at an initial position;

positioning a spacer proximal to and between two of the plurality of decorative screen panels thereby maintaining a separation between the two decorative screen panels, wherein the spacer is substantially cuboid shaped and positioned to receive a portion of a camlock device within an opening extending through a sidewall of the spacer and into a central portion of the spacer, the camlock device comprising a top portion and a bottom portion which are integrally formed; and configuring the camlock device to cooperate with the spacer and the plurality of decorative screen panels, wherein the top portion of the camlock device is positioned over the spacer, at least a first portion of the bottom portion of the camlock device is positioned within the spacer, and wherein a second portion of the bottom portion of the camlock device is positioned under the spacer and the plurality of decorative screen panels, and wherein the camlock device is configured to rotate relative to the spacer and the plurality of decorative screen panels such that, in a locked configuration, that the rotation relative to the spacer secures the camlock device within the spacer and secures the plurality of decorative screen panels at the initial position.

12. The method of claim 11, further comprising:

rotating the first portion of the camlock device in a perpendicular direction in alignment with the second portion of the camlock device.

13. The method of claim 11, further comprising:

positioning the spacer between the top portion of the camlock device and the bottom portion of the camlock device.

14. The method of claim 11, further comprising: positioning the top portion of the camlock device in contact with an exterior portion of the plurality of decorative screen panels.

15. The method of claim 11, wherein the bottom portion of the camlock device is configured under the exterior portion of the plurality of decorative screen panels to secure the spacer within the exterior portion of the plurality of decorative screen panels.

16. The method of claim 11, wherein in a first configuration the top portion and the bottom portion of the camlock device are substantially aligned with the spacer, and in a second configuration the top portion and bottom portion of the camlock device are substantially perpendicular relative to the spacer.

17. The method of 16, wherein the first configuration is an unlocked configuration and the second configuration is a locked configuration capable of securing the spacer and the plurality of decorative screen panels.

18. The method of claim 16, wherein the spacer is secured in between the top portion of the camlock device and the bottom portion of the camlock device in the locked configuration.

19. The method of claim 11, wherein the camlock device secures the plurality of decorative screen panels in between one or more frame members.

* * * * *